US005106818A

United States Patent [19]

Ashida

[11] Patent Number: 5,106,818

[45] Date of Patent: Apr. 21, 1992

[54] RECEIVING SHEET FOR HEAT TRANSFER RECORDING

[75] Inventor: Tetsuya Ashida, Tokyo, Japan

[73] Assignee: Mitsubishi Paper Mills Limited, Japan

[21] Appl. No.: 514,967

[22] Filed: Apr. 26, 1990

[30] Foreign Application Priority Data

| | | | |
|---|---|---|---|
| Apr. 27, 1989 | [JP] | Japan | 1-109675 |
| May 19, 1989 | [JP] | Japan | 1-126475 |
| Jun. 9, 1989 | [JP] | Japan | 1-147750 |

[51] Int. Cl.[5] ..... B41M 5/035; B41M 5/26

[52] U.S. Cl. ..... 503/227; 8/471; 428/195; 428/211; 428/327; 428/342; 428/402; 428/500; 428/537.5; 428/913; 428/914

[58] Field of Search ..... 8/471; 428/195, 500, 428/913, 914, 211, 327, 341, 342, 402, 537.5; 503/227

[56] References Cited

U.S. PATENT DOCUMENTS

| | | | |
|---|---|---|---|
| 4,774,224 | 9/1988 | Campbell | 503/227 |
| 4,778,782 | 10/1988 | Ito et al. | 503/227 |
| 4,837,200 | 6/1989 | Kondo et al. | 503/227 |

FOREIGN PATENT DOCUMENTS

| | | | |
|---|---|---|---|
| 60-236794 | 11/1985 | Japan | 503/227 |
| 62-198497 | 2/1987 | Japan | 503/227 |
| 1-267090 | 10/1989 | Japan . | |

*Primary Examiner*—Bruce H. Hess

[57] ABSTRACT

Disclosed is a receiving sheet for heat transfer recording which comprises a substrate, a resin layer provided at least on one side of the substrate and a sublimable-dye-receiving layer provided on the resin layer and, if necessary, a layer containing high polymer microspheres. The receiving sheet for heat transfer recording forms images having a high optical density and white dots and curling are not substantially caused therein.

8 Claims, No Drawings

RECEIVING SHEET FOR HEAT TRANSFER RECORDING

BACKGROUND OF THE INVENTION

The present invention relates to a receiving sheet for heat transfer recording used to making a record by transferring sublimable dye or the like on a heat transfer sheet in a heat transfer recording system such as a thermal printer.

Conventionally known receiving sheets for heat transfer recording include a synthetic paper having a receiving layer composed of saturated polyester resin or the like provided on one side thereof. This kind of the receiving sheet for heat transfer recording is used together with a heat transfer sheet comprising a film composed of polyethylene terephthalate having a heat transfer layer composed of sublimable dye, binder and the like provided on one side thereof. These sheets are overlapped together in such a manner that the heat transfer layer is brought into contact with the receiving layer, and the heat transfer sheet is heated from the back side thereof by a dot type heat sensitive means such as a thermal head or the like which generates heat while controlled by electric signals in accordance with image information to transfer the sublimable dye in the heat transfer layer onto the receiving layer, whereby a transferred image like a natural color photograph can be obtained.

When, however, the above conventional receiving sheet for heat transfer recording comprises a synthetic paper composed of a resin having low heat resistance such as a polyolefin resin or the like as a substrate, strain is caused in the synthetic paper by the heat applied thereto when the heat transfer is carried out, and thus the receiving sheet is curled after an image has been formed. Further, when synthetic paper composed of a resin having high heat resistance is used as the substrate, an image having sufficient optical density cannot be obtained, because the substrate has poor cushioning and heat insulating properties and the like.

To solve these problems, various trials have been carried out.

For example, Japanese Patent Application Kokai (Laid-Open) No. 62-198497 proposes a receiving sheet for heat transfer recording comprising as a substrate a sheet composed of a core member having a synthetic paper adhered to at least one side thereof. Although this proposal improves the anticurl property of the receiving sheet for heat transfer recording after an image has been formed thereon, a problem such as deficiency of the transferred image and the like arises, because this sheet is inferior to a sheet composed only of a synthetic paper in smoothness. Japanese Patent Application Kokai No. 60-236794 discloses a receiving sheet for heat transfer recording composed of a substrate on which a thermoplastic resin layer is formed. In this receiving sheet, however, a problem arises in that the receiving sheet cannot provide sufficient image reproducibility and is inadequately fed while printing depending on types of resins, and at the worst case the receiving sheet cannot be fed at all by being fused and adhered to a heat transfer sheet, and the like. Further, U.S. Pat. No. 4,774,224 proposes to use a resin-coated paper having small average roughness as a receiving sheet for heat transfer recording. Although this proposal improves the anticurl property of the receiving sheet for heat transfer recording after an image has been formed thereon, a problem arises in that the receiving sheet is inadequately fed while printing, an image having sufficient optical density cannot be obtained, and the like similar to the receiving sheet disclosed in Japanese Patent Application Kokai No. 60-236794.

SUMMARY OF THE INVENTION

It is an object of the present invention to provide a receiving sheet for heat transfer recording which does not cause the above problems in that a receiving sheet is curled, the receiving sheet is inadequately fed while printing, an image to be formed has insufficient optical density, defects are caused in a transferred image, and the like.

The present inventors have zealously made studies to achieve the above object, and, as a result, found that the object can be achieved by a receiving sheet for heat transfer recording comprising a substrate, a resin layer provided at least on one side of the substrate, and a sublimable-dye-receiving layer formed on the resin layer, wherein a specific material is used for the substrate or the resin layer, or a layer containing high polymer microspheres is additionally provided between the substrate and the resin layer.

According to the present invention, there is provided a receiving sheet for heat transfer recording which comprises a substrate, a resin layer provided at least on one side of the substrate and a sublimable-dye-receiving layer provided on the resin layer, the resin layer comprising polyolefin resins containing high-density polyethylene in an amount of at least 10% by weight based on the total weight of the polyolefin resins (referred to as "first invention" hereinafter).

According to the present invention, there is further provided a receiving sheet for heat transfer recording which comprises a substrate, a resin layer provided at least on one side of the substrate and a sublimable-dye-receiving layer provided on the resin layer, wherein a layer containing high polymer microspheres is provided between the substrate and the resin layer (referred to as "second invention" hereinafter).

According to the present invention, there is still further provided a receiving sheet for heat transfer recording which comprises a substrate, a resin layer provided at least on one side of the substrate and a sublimable-dye-receiving layer provided on the resin layer, the substrate being a natural pulp paper containing sulfite pulp in an amount of at least 40% by weight based on the total weight of the natural pulp paper, and the resin layer comprising polyolefin resins and being provided in a proportion of 5–25 g/m$^2$ (referred to as "third invention" hereinafter).

DETAILED DESCRIPTION OF THE INVENTION

A receiving sheet for heat transfer recording according to the present invention comprises a substrate, a resin layer, a sublimable-dye-receiving layer, and optionally, a layer containing high polymer microspheres.

First, the first invention will be described.

In the first invention, included as a substrate are natural pulp paper mainly composed of softwood pulp, hardwood pulp, the mixture thereof, and the like; synthetic pulp paper mainly composed of synthetic pulp; synthetic paper composed of synthetic resins such as polyolefin, polyester, etc; and resin film such as polyethylene terephthalate film, polyvinyl chloride film, polyethylene film, etc. Among them, the natural pulp paper (hereinafter, referred to as "base paper") is preferably used. To improve the optical density of a transferred image and prevent the white dots thereof, the base paper contains sulfite pulp in an amount of preferably at least 40% and more preferably at least 50% by weight based on the weight thereof. The base paper includes wood free paper, art paper, coat paper, machine glazed paper, impregnated paper, paper board and the like.

Although the thickness of the substrate is not critical it is preferably 20 to 300 μm and more preferably 30 to 250 μm taking feel and the like into consideration.

In the first invention, the resin layer is composed at least one polyolefin resin and contains high-density polyethylene in an amount of at least 10% by weight based on the total weight of the polyolefin resin. The term "high-density polyethylene" used herein is polyethylene having a density of at least 0.942 classified by JIS K 6748. When the high-density polyethylene content is less than 10% by weight, the resin layer is softened by heat generated by a thermal head while printing is carried out by a printer, and thus a receiving sheet is inadequately fed. When the aptitude for melting and extrusion coating of a resin composition is taken into consideration, the high-density polyethylene content is preferably 10 to 80% by weight.

Polyolefin resins constituting the resin layer other than the high-density polyethylene can be preferably coated by extrusion. Specifically, the polyolefin resins other than the high-density polyethylene include homopolymers such as low-density polyethylene, polypropylene, polybutene, polypentene, etc; copolymer of at least two olefins such as ethylene-propylene copolymer; linear low-density polyethylene, which is a copolymer of ethylene and α olefin; and mixtures thereof. Resins having various densities and melt indexes may be used alone or in mixture. Particularly, in the first invention, low-density polyethylene, middle-density polyethylene, polypropylene and ethylene-propylene copolymer is preferably used alone or in an admixture of at least two resins in addition to the high-density polyethylene.

The resin layer may contain a white pigment to improve the whiteness of the receiving sheet for heat transfer recording. Titanium oxide, zinc oxide, talc, calcium carbonate, etc can be used as the white pigment. Further, the resin layer may contain a suitable combination of fatty acid amide such as stearic acid amide, arachic acid amide, etc.; a metal salt of a fatty acid such as zinc stearate, calcium stearate, aluminum stearate, magnesium stearate, zinc palmitate, zinc myristate, calcium palmitate, etc.; various antioxidants such as hindered phenol, hindered amine, phosphorus type antioxidant, sulfuric type antioxidant, etc; blue pigment and dye such as cobalt blue, ultramarine, cerulean blue, phthalocyanine blue, etc.; magenta pigment and dye such as cobalt violet, fast violet, manganese violet, etc.; and various additives such as a fluorescent brightening agent, a ultraviolet absorbing agent, etc.

The resin layer is formed by a melting and extrusion coating method in which molten resin is coated onto a running base paper. The coating weight of the resin layer is preferably 5 to 25 g/m$^2$. When it is less than 5 g/m$^2$, white dots in a printed portion (hereinafter referred to as "white dots") are recognized, and when it is greater than 25 g/m$^2$, a receiving sheet having sufficient sensitivity cannot be obtained.

The improvement of the optical density of a transferred image and the prevention of white dots can be achieved to some degree by containing at least 10 wt % of high-density polyethylene in the resin layer. To more effectively achieve them, however, a high polymer microsphere layer described in the second invention is preferably provided between the substrate and the resin layer and/or a base paper used in the third invention is preferably used as the substrate.

In the present invention, a sublimable-dye-receiving layer contains synthetic resin as an essential component. The synthetic resin includes a resin having an ester linkage such as polyester resin, polyacrylic ester resin, polycarbonate resin, polyvinyl acetate resin, styrene-acrylate resin, vinyltoluene-acrylate resin, etc.; resin having an urethane linkage such as polyurethane resin, etc.; resin having an amide linkage such as polyamide resin, etc.; resin having a urea linkage such as urea resin, etc.; polycaprolactam resin; styrene resin; polyvinyl chloride resin; vinyl chloride-vinyl acetate copolymer resin; and polyacrylonitrile resin, etc. A mixture or copolymer of the above resins, and the like may be used in addition to them.

The sublimable-dye-receiving layer may contain a releasing agent, a pigment, etc. in addition to the above synthetic resins. Specifically, the releasing agent includes solid waxes such as polyethylene wax, amide wax, teflon powder, etc.; fluoric or phosphoric-ester type surface-active agent; silicone oils, etc. Among these releasing agents, the silicone oil is most preferable. As the above silicone oil, an oilic type may be used, but a curing type is preferably used. Although the curing type silicone oil includes a reaction curing type, a photo curing type, a catalyst curing type and the like, the reaction curing type silicone oil is particularly preferable. The reaction type silicone oil includes amino-modified silicone oil, epoxy-modified silicone oil, etc. The above reaction curing type silicone oil is contained in an amount of preferably 0.1 to 20% by weight based on the weight of the sublimable-dye-receiving layer. The pigment is preferably an extender pigment such as silica, calcium carbonate, titanium oxide, zinc oxide, etc.

The sublimable-dye-receiving layer has a thickness of, preferably 0.5 to 20 μm, more preferably 1 to 10 μm.

In the first invention, another resin layer may be provided on the side (i.e., back side) of the base paper opposite to the side on which the sublimable-dye-receiving layer is formed (i.e., back side) to provide the base paper with an anticurl property, a paper feed aptitude, an antistatic property, and the like. Although any resins may be used as the resin constituting the resin layer on the back side, the same resins as those constituting the resin layer on the front side may be preferably used. The coating weight of the resin layer on the back side may be suitably set in a range it is balanced with the coating weight of the resin layer on the front side.

Next, the second invention will be described.

The high polymer microspheres used in the second invention are preferably resin particles of hollow structure or multi-phase structure.

The resin particles of hollow structure have a void inside thereof and a particle size of 0.5 to 50 μm. Resin constituting the resin particles of hollow structure includes styrene resin such as polystyrene, poly-γ-methylstyrene, etc.; acrylic resin such as poly(methyl methacrylate), poly(ethyl methacrylate), etc.; copolymer of styrene and acrylic monomer; vinyliden chloride-acrylonitrile copolymer, etc.

The resin particles of multi-phase structure are made by a seed emulsion polymerization method, have at least two kinds of polymers coexisting in a particle, and are formed to a shape of a slightly or keenly rugged glove, a gourd or the like. The resin particles of multi-phase structure are obtained in such a manner that a kind of monomer is subjected to a seed emulsion polymerization in polymer particles serving as seeds which are obtained by emulsion polymerizing another kind of monomer, whereby particles composed of two kinds of polymers are made. In the resin particles of multi-phase structure, at least two kinds of polymers are separated each other and form a multi-phase structure. The resins constituting the resin particles of multi-phase structure includes ethyl acrylate-styrene copolymer resin, butyl acrylate-styrene copolymer resin, methyl methacrylate-styrene copolymer resin, etc. An outside diameter of the high polymer microsphere particles is preferably 10 μm or less, more preferably 5 μm or less, further preferably 3 μm or less.

Although the layer containing the high polymer microspheres may be a layer composed of the microspheres alone, the layer is preferably composed of a combination of the microspheres and a suitable binder. The binder is contained in an amount of preferably 5–150 parts, more preferably 10–50 parts by weight per 100 parts by weight of the high polymer microspheres.

The layer containing the high polymer microspheres may further contain an inorganic or organic pigment (not the resin particles of hollow structure). Specifically, the inorganic pigment includes clay, talc, calcium carbonate, calcium sulfate, barium sulfate, titanium oxide, zinc oxide, satin white, silicon oxide, zeolite, magnesium hydroxide, alumina, synthetic silica, calcium silicate, diatomaceous earth, aluminum hydroxide, etc. The organic pigment includes polyethylene, polystyrene, polyester, urea-formaldehyde resin, polyamide resin, etc.

Used as the binder in the layer containing the high polymer microspheres is a water-soluble polymer, a synthetic resin latex, an organic solvent-soluble resin, an ultraviolet- or electron beam-curable resin, etc.

Used as the water-soluble polymer is starches such as oxidized starch, etherfied starch, dextrin, phosphoric esterified starch, etc.; cellulose derivatives such as carboxymethyl cellulose, hydroxymethyl cellulose, etc.; casein; gelatin; poly(vinyl alcohol) and derivatives thereof; maleic anhydride resin; copolymers composed of maleic anhydride and at least one monomer selected from the group consisting of ethylene, styrene, isobutadiene, vinyl acetate, etc.; and the like.

The synthetic resin latex includes conjugated diene copolymer latex such as styrene-butadiene copolymer, methyl methacrylate-butadiene copolymer, etc.; acrylic polymer latex such as polyacrylic acid ester, polymethacrylic acid ester, copolymer of acrylic acid ester and methacrylic acid ester, etc.; vinyl polymer latex such as ethylene-vinyl acetate copolymer, etc.; and functional group-modified polymer of these various polymers, which is modified with a monomer containing a functional group such as of a carboxyl group and the like.

The organic solvent-soluble resin includes polyacrylnitrile, poly(vinyl chloride), poly(vinyl acetate), melamine resin, phenol resin, polyurethane, polyamide, alkyd resin, etc.

The UV or EB curable resin includes resin having a C=C unsaturated bond such as an acryloyl or methacryloyl group at a molecular side chain or endgroup. A typical example thereof includes ester acrylate, ester methacrylate, epoxy acrylate, epoxy methacrylate, urethane acrylate, urethane methacrylate, monofunctional acrylate, monofunctional methacrylate, multifunctional acrylate, and multifunctional methacrylate.

The layer containing the high polymer microspheres may, if necessary, contain a dispersing agent, viscosity increasing agent, antifoaming agent, coloring agent, antiseptic, pH conditioning agent, etc. in addition to the binder.

A machine such as a blade coater, roll coater, brush coater, curtain coater, bar coater, gravure coater, sizing press or the like can be used to coat the base paper with the high polymer microspheres.

To provide the base paper with smoothness after the layer containing the high polymer microspheres has been provided thereon, it may be treated by a supercalendar, gloss calendar, or the like.

The coating weight of the high polymer microspheres is preferably 0.5 to 50 $g/m^2$ and more preferably 1 to 20 $g/m^2$. A necessary amount of the high polymer microspheres may be coated once. Otherwise a certain amount thereof may be coated at least 2 times to obtain the necessary coating weight.

Those exemplified as the substrate in the first invention may be also used in the second invention.

Although the resin composing the resin layer in the second invention is not particularly limited as far as it can be formed to a film, it is preferably resins capable of being coated by extrusion such as for example, polyolefin resins, polyethylene terephthalate resin, ethylene-vinyl acetate copolymer resin, etc. The polyolefin resins include homopolymer such as low-destiny polyethylene, high-density polyethylene, polypropylene, polybutene, polypentene, etc.; copolymer composed of at least two olefins such as ethylene-propylene copolymer, etc.; linear low-density polyethylene, which is copolymer of ethylene and α olefin; and mixtures thereof. Resins having various densities and melt indexes may be used alone or in admixture. Particularly, low-density polyethylene, high-density polyethylene, middle-density polyethylene, polypropylene, ethylene-propylene copolymer, etc. are preferably used alone or in admixture of at least two kinds of them. The high-density polyethylene in an amount of at least 10 wt % is preferably contained in the resin based on the weight thereof from a view point to prevent the receiving sheet from being inadequately fed while printing.

In the second invention, the resin layer may contain, in a proper combination; fatty acid amide; a metal salt of a fatty acid; antioxidant; blue pigment or dye; magenta pigment or dye; and various additives; which are exemplified in the first, invention.

A thickness of the resin layer is preferably 3 to 50 μm and more preferably 5 to 30 μm.

The sublimable-dye-receiving layer described in the first invention can also be used in the second invention.

In the second invention, another resin layer can be also provided on the back side of the substrate in the same way as in the first invention.

The third invention will be described below.

In the third invention, natural pulp paper (hereinafter, referred to as "base paper") containing sulfite pulp in an amount of at least 40% and preferably at least 50% by weight based on the weight of the natural pulp paper is used as the substrate. When the sulfite pulp content is less than 40% by weight, the softness, cushioning property and the like of the base paper are deteriorated, the sensitivity thereof is lowered, and a lot of white dots are caused in a printed portion.

Although sulfite pulp contained in the base paper includes softwood sulfite pulp, hardwood sulfite pulp and a mixture thereof, it is preferably that the hardwood sulfite pulp is mainly used.

The base paper may contain natural pulp other than sulfite pulp, synthetic pulp or a mixture thereof in addition to the sulfite pulp. The base paper is preferably made by a Fourdrinier paper machine. Further, the base paper is preferably treated by a machine calendar, supercalendar, heat calendar or the like to improve the smoothness thereof after it has been made.

In this invention, although a thickness of the base paper is not critical, it is preferably 20 to 300 μm and more preferably 30 to 250 μm taking fuel and the like into consideration.

In the third invention, the resins constituting the resin layer exemplified in the second invention can also be used as the resins constituting the resin layer.

In the third invention, the resin layer may also contain, in a proper combination, white pigment; fatty acid amide; metal salt of fatty acid; antioxidant; blue pigment or dye; magenta pigment or dye; and various additives; which are shown in the first invention as examples.

A thickness of the resin layer is preferably 3 to 50 μm and more preferably 5 to 30 μm.

The layer containing the high polymer microspheres described in the second invention is preferably provided between the base paper and the resin layer for the improvement of the optical density of a transferred image and the prevention of white dots.

The sublimable-dye-receiving layer described in the first invention is also used in the third invention.

In the third invention, another resin layer can be provided on the back side of the substrate in the same way as in the first invention.

DESCRIPTION OF PREFERRED EMBODIMENT OF THE INVENTION

The present invention will be described below in detail with reference to examples, but is not limited to these examples.

EXAMPLES 1-14

Resin compositions shown in Table 1 were melted and coated by extrusion on one side (front side) of a wood free paper having a basis weight of 150 g/m$^2$ composed of hardwood sulfite pulp in an amount of 50% and softwood sulfite pulp in a amount of 50% at a resin temperature of 330° C. to form a resin layer. Next, the same resin compositions as used above to form the resin layer were melted and coated by extrusion on the side (back side) opposite to the front side at a resin temperature of 330° C. to the same thickness as that of the resin layer coated on the front side. Finally, the front side was subjected to a corona discharge treatment and then a sublimable-dye-receiving layer having the following composition was coated using a wire bar and dried to form a receiving layer having a solid pickup of 5 mg/m$^2$, whereby a receiving sheet for heat transfer recording was obtained.

| Composition for sublimable-dye-receiving layer | |
|---|---|
| Polyester resin (vylon 200: mfd. by Toyobo Co., Ltd.): | 10 weight parts |
| Amino modified silicon (KF-393: mfd. by Shinetsu Chemical Co., Ltd.): | 0.5 weight part |
| Epoxy modified silicon (X-22-343: mfd. by Shinetsu Chemical Co., Ltd.): | 0.5 weight part |
| Solvent (toluene/methyl ethyl ketone = 1/1): | 89 weight parts |

Next, an ink having the following composition for forming a heat sensitive sublimable transfer layer was prepared, coated on a polyethylene terephthalate film of 6 μm thick having a back side subjected to a heat resistant treatment and dried to have a solid pickup of 1 g/m$^2$, whereby a heat transfer sheet was obtained.

| | |
|---|---|
| Dispersion dye (KST-B-714: mfd. by Nihon Kayaku Co., Ltd.): | 4 weight parts |
| Polyvinyl butyral resin (BX-1: mfd. by Sekisui Chemical Co., Ltd.): | 4 weight parts |
| Solvent (toluene/methyl ethyl ketone = 1/1) | 92 weight parts |

Each pair of the thus obtained heat transfer sheets and the receiving sheets for heat transfer recording were overlapped together and an energy of 0.3 mJ or 2 mJ was imposed thereto by a thermal head to carry out solid printing. Table 1 shows the results of the printing.

The evaluation and determination for Table 1 were made as follows.

Feed Property of Receiving Sheet

A feed property of receiving sheets which were fed through a printer was determined based on the state thereof while printing and after the printing had been completed at applied energy of 2 mJ.

○: Receiving sheets were fed well.

Δ: Printed characters were curved, because receiving sheets were inadequately fed.

×: Receiving sheets were not fed at all.

Transfer Density

A transfer density of cyanide at applied energy of 2 mJ was measured using a reflection densitometer (Macbeth, model RD519). The higher the transfer density, the higher the sensitivity.

White dots

The occurrence of white dots in a printed portion was visually determined, when half tone printing was carried out at applied energy of 0.3 mJ.

○: White dots were not substantially observed.

Δ: White dots were a little observed.

×: White dots were remarkably observed.

TABLE 1

| | Composition of resin layer | | | |
|---|---|---|---|---|
| | Resin A | wt % | Resin B | wt % |
| Example 1[1)] | Low-density polyethylene (density 0.92, MI = 5) | 90 | — | — |
| Example 2[1)] | Low-density polyethylene (density 0.92, MI = 5) | 85 | High-density polyethylene (density 0.96, MI = 5) | 5 |
| Example 3[1)] | Low-density polyethylene (density 0.92, MI = 5) | 80 | High-density polyethylene (density 0.96, MI = 5) | 10 |
| Example 4[1)] | Low-density polyethylene (density 0.92, MI = 5) | 60 | High-density polyethylene (density 0.96, MI = 5) | 30 |

TABLE 1-continued

| | | | | |
|---|---|---|---|---|
| Example 5[1)] | Low-density polyethylene (density 0.92, MI = 5) | 20 | High-density polyethylene (density 0.96, MI = 5) | 70 |
| Example 6[1)] | — | — | High-density polyethylene (density 0.96, MI = 5) | 90 |
| Example 7[1)] | Low-density polyethylene (density 0.92, MI = 5) | 60 | High-density polyethylene (density 0.96, MI = 5) | 30 |
| Example 8[1)] | Low-density polyethylene (density 0.92, MI = 5) | 60 | High-density polyethylene (density 0.96, MI = 5) | 30 |
| Example 9[1)] | Low-density polyethylene (density 0.92, MI = 5) | 60 | High-density polyethylene (density 0.96, MI = 5) | 30 |
| Example 10[1)] | Low-density polyethylene (density 0.92, MI = 5) | 60 | High-density polyethylene (density 0.96, MI = 5) | 30 |
| Example 11[2)] | Low-density polyethylene (density 0.92, MI = 5) | 60 | High-density polyethylene (density 0.96, MI = 5) | 30 |
| Example 22[3)] | Low-density polyethylene (density 0.92, MI = 5) | 70 | High-density polyethylene (density 0.96, MI = 5) | 30 |
| Example 33[1)] | Low-density polyethylene (density 0.92, MI = 5) | 60 | Low-density polyethylene (density 0.91, MI = 7) | 30 |
| Example 14[1)] | Low-density polyethylene (density 0.92, MI = 5) | 60 | Medium-density polyethylene (density 0.93, MI = 5) | 30 |

| Coating weight of resin (g/m²) | Evaluation: Feed property of receiving sheet | Transfer density | White dots |
|---|---|---|---|
| 15 | X | 4)— | 4)— |
| 15 | Δ | 1.60 | ○ |
| 15 | ○ | 1.55 | ○ |
| 15 | ○ | 1.55 | ○ |
| 15 | ○ | 1.50 | ○ |
| 15 | ○ | 1.50 | ○ |
| 15 | ○ | 1.55 | ○ |
| 3 | ○ | 1.70 | Δ |
| 5 | ○ | 1.65 | Δ~○ |
| 30 | ○ | 1.40 | ○ |
| 15 | ○ | 1.55 | ○ |
| 15 | ○ | 1.55 | ○ |
| 15 | X | 4)— | 4)— |
| 15 | Δ | 1.55 | ○ |

Note:
1)The resin layer contained anatase type titanium dioxide in an amount of 10% by weight.
2)The resin layer contained zinc oxide in an amount of 10% by weight.
3)No white pigment was contained.
4)Measurement was impossible because the receiving sheet were not fed at all.

As apparent from the results of Table 1, all of the receiving sheets for heat transfer recording of the first invention were very excellent and no curling of the receiving sheets was observed after printing had been completed. The Example 12, however, was a little inferior to the Examples 11 and 4 in resolution.

As apparent from the above results, all of the receiving sheets for heat transfer, recording of the first invention had a good feed property, no white dots occurred therein, and a high transfer density, whereby a beautiful image could be obtained.

EXAMPLES 15-22

A layer containing high polymer microspheres shown in Table 2 was coated by a blade coater on one side (front side) of a wood free paper composed of hardwood kraft pulp having a basis weight of 150 g/m² and dried to obtain a dried coating weight of 10 g/m². Next, a resin composition composed of 10% of anatase type titanium oxide containing low-density polyethylene (a density of the polyethylene before titanium oxide was added: 0.92 g/cm³, MI=5) and high-density polyethylene (a density of the polyethylene before titanium oxide was added: 0.96 g/cm³, MI=5) in a ratio of 7:3 was melted and coated by extrusion on the layer containing high polymer microspheres formed above to a thickness of 20 μm at a resin temperature of 330° C. Next, a resin composition composed of the low-density polyethylene (density: 0.92 g/cm³, MI=5) and the high-density polyethylene (density: 0.96 g/cm³, MI=5) in a ratio of 1:1 was melted and coated by extrusion on the side (back side) opposite to the side where the coated layer was formed to a thickness of 20 μm at a resin temperature of 330° C. Thereafter, the same procedure as in Example 1 was repeated to obtain a receiving sheet for heat transfer recording.

Thus obtained receiving sheet for heat transfer recording and the heat transfer sheet used in Example 1 were overlapped together and solid painting was carried out at applied energy of 0.3 mJ or 2 mJ.

Note that the method of evaluation and determination in Table 2 are the same as those of Table 1.

TABLE 2

| | Layer containing high polymer microsphere: Particle sphere | Composition | Brand name | Binder[1)] | Evaluation: Transfer density | White dots | Curling |
|---|---|---|---|---|---|---|---|
| Example 15 | Hollow resin particles | Styrene. acryl | OP-84J (Rohm & Haas Co.) | Styrene-butadiene copolymer | 1.9 | ○ | ○ |
| Example 16 | Hollow resin particles | Styrene. acryl | OP-84J (Rohm & Haas Co.) | Gelatine | 1.9 | ○ | ○ |
| Example 17 | Hollow resin particles | Styrene. acryl | PP-207S (Dainippon Ink Chemical Co., | Styrene-butadiene copolymer | 1.85 | ○ | ○ |

TABLE 2-continued

| | Layer containing high polymer microsphere | | | | Evaluation | | |
|---|---|---|---|---|---|---|---|
| | Particle sphere | Composition | Brand name | Binder[1)] | Transfer density | White dots | Curling |
| | | | Ltd.) | | | | |
| Example 18 | Hollow resin particles | Styrene | PP-199 (Dainippon Ink Chemical Co., Ltd.) | Styrene-butadiene copolymer | 1.85 | ○ | ○ |
| Example 19 | Multi-phase particles | Styrene. acryl | XMRP-140 (Mitsui Toatsu Chemical Co., Ltd.) | Styrene-butadiene copolymer | 1.8 | ○ | ○ |
| Example 20 | Multi-phase particles | Styrene. acryl | XMRP-160 (Mitsui Toatsu Chemical Co., Ltd.) | Styrene-butadiene copolymer | 1.8 | ○ | ○ |
| Example 21 | Resin particles | Urea resin | UF (Mitsui Toatsu Chemical Co., Ltd.) | Styrene-butadiene copolymer | 1.4 | Δ | ○ |
| Example 22 | — | — | — | Styrene-butadiene copolymer | 1.4 | X | ○ |

[1)]The binder content of the layer containing the high polymer microsphere is 20 wt %.
[2)]Non-hollow resin particles

EXAMPLES 23–28

Receiving sheets for heat transfer recording were prepared and evaluated in the same manner as in Example 15 except that the coating weight of the resin layer was varied as shown in Table 3.

TABLE 3

| | Coating[3)] weight of resin ($g/m^2$) | Evaluation | | |
|---|---|---|---|---|
| | | Transfer density | White dots | Curling |
| Example 15 | 20 | 1.9 | ○ | ○ |
| Example 23 | 0 | 1.7 | X | X |
| Example 24 | 3 | 2.0 | Δ | Δ |
| Example 25 | 5 | 2.0 | ○ | ○ |
| Example 26 | 30 | 1.9 | ○ | ○ |
| Example 27 | 50 | 1.75 | ○ | ○ |
| Example 28 | 70 | 1.6 | ○ | ○ |

[3)]The same amount of the resin was coated on the front and back sides.

EXAMPLES 29 AND 30

Receiving sheets for heat transfer recording were prepared and evaluated in the same manner as in Example 15 except that the pigment in the resin layer was changed as shown in Table 4.

TABLE 4

| | White pigment in resin layer |
|---|---|
| Example 15 | Titanium dioxide |
| Example 29 | Zinc oxide |
| Example 30 | Nil |

Although the transfer density, white dots and curling of Examples 29 and 30 were the same as those of Example 15, Example 30 was a little inferior to Examples 15 and 29 in the resolution of an image.

As apparent from the above results, all of the receiving sheets for heat transfer recording of the second invention had no white dots or no curling occurred therein, and a high transfer density, whereby a beautiful image could be obtained.

EXAMPLES 31–42

A resin composition composed of 10% of anatase type titanium oxide containing low-density polyethylene (a density of the polyethylene before titanium oxide was added: 0.92 $g/cm^3$, MI=5) and high-density polyethylene (a density of the polyethylene before titanium oxide was added: 0.96 $g/cm^3$, MI=5) in a ratio of 7:3 was melted and coated by extrusion on the base paper (front side) shown in Table 5 to the coating amounts of resin shown in Table 1 at a resin temperature of 330° C. Next, the same resin composition as that coated on the front side but not containing any titanium oxide was melted and coated by extrusion on the side (back side) opposite to the front side at a resin temperature of 330° C. to the same thickness as that coated on the front side. Thereafter, the same procedure as in Example 1 was repeated to obtain a receiving sheet for heat transfer recording.

The thus obtained receiving sheets for heat transfer recording were evaluated by repeating the same procedure as in Example 1. The results are shown in Table 5.

TABLE 5

| | Kind and amount of pulp used for base paper[1)] | | | | Coating weight of resin ($g/m^2$) | Evaluation | |
|---|---|---|---|---|---|---|---|
| | 2) LSP | 3) NSP | 4) LBKP | 5) NBKP | | Transfer density | White dots |
| Example 31 | 100 | 0 | 0 | 0 | 15 | 1.65 | ○ |
| Example 32 | 50 | 50 | 0 | 0 | 15 | 1.65 | ○ |
| Example 33 | 50 | 20 | 30 | 0 | 15 | 1.60 | ○ |
| Example 34 | 50 | 0 | 50 | 0 | 15 | 1.60 | ○ |
| Example 35 | 40 | 0 | 60 | 0 | 15 | 1.60 | ○~Δ |
| Example 36 | 30 | 0 | 70 | 0 | 15 | 1.55 | Δ |
| Example 37 | 0 | 0 | 50 | 50 | 15 | 1.50 | X |
| Example 38 | 0 | 0 | 100 | 0 | 15 | 1.50 | X |
| Example 39 | 50 | 0 | 50 | 0 | 3 | 1.70 | X |
| Example 40 | 50 | 0 | 50 | 0 | 5 | 1.65 | Δ |
| Example 41 | 50 | 0 | 50 | 0 | 25 | 1.55 | ○ |
| Example 42 | 50 | 0 | 50 | | 35 | 1.30 | ○ |

[1)]% by weight based on the weight of base paper
[2)]hardwood sulfite pulp
[3)]softwood sulfite pulp
[4)]hardwood kraft pulp
[5)]softwood kraft pulp As apparent from the results of Table 5, all of the receiving sheets for heat transfer recording of the third invention were excellent. No curling of the sheets was observed after printing had been effected.

EXAMPLE 43

A receiving sheet for heat transfer recording was made and evaluated by repeating the same procedure as in Example 31 except that the resin layer on the front side thereof did not contain and titanium oxide. It is as good as Example 31 in transfer density and white dots, but was inferior to it in the resolution of images.

As apparent from the above results, all of the receiving sheets for heat transfer recording of the third invention did not have white dots and curling, had high transfer density, whereby a beautiful image could be obtained.

What is claimed is:

1. A receiving sheet for heat transfer recording which comprises a substrate, a layer which contains polymer microspheres and is provided on one side of the substrate, a resin layer which comprises polyolefin resins and is provided on the layer containing microspheres, and a sublimable-dye-receiving layer provided on the resin layer.

2. A receiving sheet for heat transfer recording according to claim 1, wherein the substrate is a natural pulp paper containing sulfite pulp in an amount of at least 40% by weight based on the weight of the natural pulp paper and the resin layer is provided in a proportion of 5 to 25 g/m$^2$.

3. A receiving sheet for heat transfer recording according to claim 1, wherein the resin layer contains high-density polyethylene in an amount of at least 10% by weight based on the weight of the polyolefin resin.

4. A receiving sheet for heat transfer recording according to claim 3, wherein the substrate is a natural pulp paper containing sulfite pulp in an amount of at least 40% by weight based on the weight of the natural pulp paper and the resin layer is provided in a proportion of 5 to 25 g/m$^2$.

5. A receiving sheet for heat transfer recording according to claim 1, wherein another resin layer comprising polyolefin resins is provided on another side of the substrate.

6. A receiving sheet for heat transfer recording according to claim 1, wherein the resin layer is provided in a proportion of 5 to 25 g/m$^2$.

7. A receiving sheet for heat transfer recording which comprises a substrate, a resin layer provided on one side of the substrate and a sublimable-dye-receiving layer provided on the resin layer, the substrate being a natural pulp paper containing sulfite pulp in an amount of at least 40% by weight based on the weight of the natural pulp paper, and the resin layer comprising polyolefin resins and being provided in a proportion of 5 to 25 g/m$^2$.

8. A receiving sheet for heat transfer recording according to claim 7, wherein another resin layer comprising polyolefin resins is provided on another side of the substrate.

* * * * *